US005441860A

United States Patent [19]

Fornasari et al.

[11] Patent Number: 5,441,860

[45] Date of Patent: Aug. 15, 1995

[54] SILVER HALIDE PHOTOGRAPHIC MATERIAL HAVING IMPROVED ANTISTATIC PROPERTIES

[75] Inventors: Brunella Fornasari, Ferrania; Giuseppe Bussi, Saliceto; Renzo Torterolo, Bragno/Cairo Montenotte, both of Italy

[73] Assignee: Minnesota Mining and Manufacturing Company, St. Paul, Minn.

[21] Appl. No.: 203,343

[22] Filed: Feb. 28, 1994

[30] Foreign Application Priority Data

Mar. 30, 1993 [EP] European Pat. Off. ..... 93105229

[51] Int. Cl.[6] ..... G03C 1/76

[52] U.S. Cl. ..... 430/537; 430/523; 430/527; 430/626; 430/950; 430/536; 430/628; 430/621

[58] Field of Search ..... 430/527, 523, 537, 626, 430/950, 536, 628, 621

[56] References Cited

U.S. PATENT DOCUMENTS

| | | | |
|---|---|---|---|
| 3,645,743 | 2/1972 | Mucke et al. | 430/626 |
| 3,843,371 | 10/1974 | Piller et al. | 430/512 |
| 4,524,131 | 6/1985 | Himmelmann et al. | 430/523 |
| 4,614,708 | 9/1986 | Timmerman et al. | 430/537 |
| 4,675,278 | 6/1987 | Sugimoto et al. | 430/523 |
| 4,684,605 | 8/1987 | Remley | 430/537 |
| 4,885,350 | 12/1989 | Yamashita et al. | 526/201 |
| 4,940,653 | 7/1990 | Lalvani et al. | 430/502 |
| 5,153,113 | 10/1992 | Hirabayashi et al. | 430/527 |

FOREIGN PATENT DOCUMENTS

| | | | |
|---|---|---|---|
| 0118793 | 9/1984 | European Pat. Off. . | |
| 0341200A1 | 11/1989 | European Pat. Off. | G03C 1/76 |

OTHER PUBLICATIONS

Research Disclosure, Apr. 1982 p. 109.
Research Disclosure, Jun. 1982, pp. 214–215.
Research Disclosure, Dec. 1989, pp. 993, 1006–1009.
Research Disclosure, Item 21617, p. 109, Apr. 1982, Anonymous.

*Primary Examiner*—Thomas R. Neville
*Attorney, Agent, or Firm*—Gary L. Griswold; Walter N. Kirn; Mark A. Litman

[57] ABSTRACT

The present invention relates to a silver halide photographic material comprising a support having coated thereon at least one silver halide emulsion layer and at least one light-insensitive hydrophilic colloid layer wherein at least one of said layers comprises a gelatin hardening agent and said hydrophilic colloid layer comprises an alkali-insoluble acrylic polymer particles having an average particle size of from 0.5 to 6 μm and wherein at least 95% by number of said polymer particles have a particle size within ±15% of the average particle size.

12 Claims, No Drawings

SILVER HALIDE PHOTOGRAPHIC MATERIAL HAVING IMPROVED ANTISTATIC PROPERTIES

FIELD OF INVENTION

The present invention relates to a silver halide photographic material having an outer light-insensitive layer with improved antistatic and surface properties.

BACKGROUND OF THE ART

The use of solid particles of water insoluble organic or inorganic materials, usually referred to as "matting agents", in silver halide photographic materials is widely known in the art.

Matting agents are usually employed in the outer protective layer over the silver halide emulsion layer(s) and/or in a backing layer at the rear of the support to provide a rough surface which is often desirable in photographic art.

Matting agents are mainly used to reduce the tackiness of the photographic material, for example when the material is in the form of a roll or a stack. They can also be used to provide a sufficient roughening of the surface to prevent the formation of Newton's rings when printing and enlarging by reduction of the contact surface between two adjacent photographic materials. Further, they can be used to decrease abrasion from dry-friction and to reduce scratching when materials are stored or packed in contact with other materials as is the case, for example, of X-ray material packed without interleaves. It is also possible to use matting agents to obtain the desired coefficient of friction for film materials intended for use in automatic apparatus for rapid or super-rapid processing. Moreover, matting agents may have a slight effect in reducing the generation of static electricity in photographic elements by reducing the area of contact between the surface of the photographic element and other materials, which can cause static discharge.

The generation of static electricity can cause a large number of difficulties during the preparation and use of photographic elements, especially film elements. The generation of static electricity can be caused by rubbing of the element against rollers and other elements through or on which the materials are guided, by contact of the film element with rough surfaces or by many other known reasons. Discharges of static electricity in an unprocessed photographic element cause local film exposure and on development the discharge images become visible in the form of irregular streaks or lines and black spots. Discharges in a processed film element are also undesirable since friction can be increased.

The reduction of static electricity provided by the matting agents is insufficient, if taken alone, to solve the problem of static marks as described above.

In the art of photography, it is widely known to use specific compounds to reduce the generation of static electricity. These compounds are usually referred to as "antistatic agents". Their use, alone or in combination with matting agents can allow the production of photographic materials that do not show all of the above mentioned drawbacks.

Examples of such antistatic agents can be found, for example, in *Research Disclosure*, December 1989, Vol. 308, Item 308119, Section XIII and June 1982, Vol. 218, Item 21809. *Research Disclosure* is a publication of Kenneth Mason Publications, Ltd., Dudley Annex, 21a North Street, Emsworth, Hampshire, England. The most common antistatic agents are surface-active organic fluoro compounds as described, for example, in U.S. Pat. Nos. 3,501,653, 3,754,924, 3,775,126, 3,850,640, 3,850,642, 3,884,699, and 4,013,696 and conductive polymers as disclosed, for example, in U.S. Pat. Nos. 5,013,673, 4,668,748, and 4,810,624.

However, the most common use of matting agents is as anti-blocking agents and for this reason EP 341,200 discloses the use of monodispersed polystyrene beads, EP 118,793 discloses the use of monodispersed polymethylmethacrylate beads having an average particle size lower than 4 μm, and *Research Disclosure*, April 1982, Item 21617 discloses the use of monodispersed polymethylmethacrylate beads having an optimal size of 1.8 μm. Monodispersed matting agents are known in the art to have a better performance relative to polydispersed matting agents. The reason is probably that polymer particles having a diameter lower than 1 μm are unsuitable as anti-blocking agents and can lead to a milky appearance which is undesirable when transparent images are required. Polymer particles having a diameter higher than 10 μm can increase the graininess of the resulting image.

Several patents and patent applications discloses the use of monodispersed polymer particles to solve the problem of static marks. For example, U.S. Pat. No. 4,940,653 discloses the use of alkali soluble copolymers or graft polymers having an average particle size of from 0.5 to 3.0 μm and U.S. Pat. No. 4,614,708 discloses the use of alkali soluble copolymers or graft copolymers having an average particle size of from 0.5 to 5.0 μm. None of these patents relates to monodispersed permanent matting agents such as polymethylmethacrylate beads which are known to be difficult to prepare. U.S. Pat. No. 4,885,350 discloses a method to prepare monodispersed vinyl polymer particles, but this method is not satisfactory to prepare monodispersed polymethylmethacrylate particles having a diameter lower than 10 μm. The use of radiographic materials comprising permanent matting agents in apparatus for rapid processing can cause the forming of aggregates of matting agent, removed from film by the action of rubber lips or blades, squeeze rollers or buff rollers, which can scratch the radiographic films during processing.

SUMMARY OF THE INVENTION

The present invention relates to a silver halide photographic material comprising a support having coated thereon at least one silver halide emulsion layer and at least one light-insensitive hydrophilic colloid layer wherein at least one of said layers comprises a gelatin hardening agent and said hydrophilic colloid layer comprises alkali-insoluble acrylic polymer particles having an average particle size of from 0.5 to 6 μm and wherein at least 95% by number of said polymer particles have a particle size within ±15% of the average particle size. In a preferred embodiment of the present invention said silver halide photographic material is fore-hardened with a triazine hardener. This invention reduces the appearance of static marks and improves the surface properties of radiographic material even if processed in automatic apparatus intended for rapid processing.

DETAILED DESCRIPTION OF THE INVENTION

The present invention relates to a silver halide photographic material comprising a support having coated thereon at least one silver halide emulsion layer and at least one light-insensitive hydrophilic colloid layer wherein at least one of said layers comprises a gelatin hardening agent and said hydrophilic colloid layer comprises alkali-insoluble acrylic polymer particles having an average particle size of from 0.5 to 6 μm and wherein at least 95% by number of said polymer particles have a particle size within ±15% of the average particle size.

The term "acrylic polymer", used to describe the polymer of the present invention, represents a polymer obtained from free radical polymerization of an acrylic monomer selected in the class of acrylic and methacrylic esters.

Examples of the polymerizable acrylic esters useful to prepare the polymer particles of the present invention are methylacrylate, ethylacrylate, n-propylacrylate, isopropylacrylate, n-butylacrylate, isobutylacrylate, sec-butylacrylate, amylacrylate, hexylacrylate, octylacrylate, 2-phenoxy-ethylacrylate, 2-chloro-ethylacrylate, 2-acetoxyethylacrylate, dimethyl-aminoethylacrylate, benzylacrylate, cyclohexylacrylate, phenylacrylate, 2-methoxyethylacrylate, and the like.

Examples of the polymerizable methacrylic esters useful to prepare the polymer particles of the present invention are methylmethacrylate, ethyl-methacrylate, n-propylmethacrylate, isopropylmethacrylate, n-butylmethacrylate, sec-butylmethacrylate, tert-butylmethacrylate, amylmethacrylate, hexylmethacrylate, cyclohexylmethacrylate, benzylmethacrylate, octylmethacrylate, N-ethyl-N-phenylaminoethylmethacrylate, dimethylaminophenoxyethylmethacrylate, phenylmethacrylate, naphthylmethacrylate, cresylmethacrylate, 2-hydroxyethylmethacrylate, 4-hydroxybutylmethacrylate, 2-methoxyethylmethacrylate, 2-butoxyethylmethacrylate, and the like.

By the term "alkali insoluble" is meant a solubility lower than 0.1 g/l at room temperature in an aqueous solution at pH 10.0. In a preferred embodiment of the invention methylmethacrylate is used.

Acrylic polymer particles useful in the material of the present invention are prepared by free radical polymerization of the above described acrylic or methacrylic esters in an hydrophilic organic solvent. In particular, the acrylic or methacrylic monomer is dissolved in the hydrophilic organic solvent, together with a polymeric dispersion stabilizer and a surface-active dispersion co-stabilizer. The solution is heated up to the boiling point of the solvent and then the polymerization is started by adding a polymerization radicalic initiator.

Examples of useful hydrophilic organic solvents are aliphatic alcohols having from 1 to 10 carbon atoms, such as, for example, methanol, ethanol, propanol, isopropanol, butanol, t-butanol, pentanol, neopentanol, cyclohexanol, octanol, and the like. These organic solvents can be used alone or in combination each other. The choice of the most suitable hydrophilic organic alcohol can depend on the solubility properties of the monomer employed for the production of the polymer particle and on the polymer so obtained. In a preferred embodiment of the present invention the hydrophilic organic solvent is methanol or ethanol.

Examples of useful polymer dispersion stabilizers are homopolymers or copolymers of monomers containing nitrogen atoms or heterocyclic rings having an average number molecular weight in the range of from 20,000 to 60,000. Specific examples of monomers are, for example, vinylpyridine, vinylpyrrolidone, N-vinylimidazole, ethyleneimine. Polyvinylpyrrolidone having an average number molecular weight of from 30,000 to 50,000 are preferred.

Examples of surface active dispersion co-stabilizers are surface active agents. Specific examples of surface active agents are cationic surfactants, such as, for example, alkylamine salts, aminoalcohol fatty acid derivatives, polyamine fatty acid derivatives, imidazolines, quaternary nitrogen salts, etc., anionic surfactants, such as, for example, alkylsulfates, alkyl and aralkyl sulfonates, alkyl phosphates, fatty acid salts, phosphorus derivatives, etc., and non-ionic surfactants, such as, for example, fatty acid amide derivatives, polyhydroxy alcohol derivatives, polyoxyalkyl derivatives, etc.

Useful radicalic polymerization initiators in the process of the present invention are an azo type initiators, such as, for example, 2,2'-azobisisobutyronitrile, or 2,2'-azobis-(2,4-dimethylvaleronitrile).

Further references to the above described polymerization method can be found in EP patent application No. 93101906.1 filed on Feb. 8, 1993.

The polymer particles of the present invention show an average diameter of from 0.5 to 6 μm, preferably of from 2 to 5 μm. At least 95% by number, preferably at least 99% by number of polymer particles, show a diameter within ±15%, most preferably within ±10%, of the average diameter.

The matting agents of the present invention are incorporated into the outer layer of the photographic material. They can be for instance incorporated into the surface protective layer coated on the silver halide emulsion layers, or into the backing layer coated on the support base on the side opposite to that containing the light-sensitive layers, or on both sides. It is more preferred, in any case, to incorporate the matting agents of the present invention into an outer protective layer. Matting agents are incorporated into the layer as small particles uniformly dispersed therein having an average diameter preferably in the range of from 2 to 4 μm.

Matting agents may be either directly dispersed in the photographic is layer or may be dispersed in aqueous solutions or in aqueous dispersions of the photographic layer binding material and then added to the coating composition prior to coating itself. They may also be incorporated in the photographic layer by dispersing a solution of the matting agent in a water-insoluble organic solvent, in an aqueous gelatin solution, eliminating the organic solvent, and then introducing the obtained dispersion into the coating composition of the photographic layer.

Matting agents are incorporated in a quantity of about 50 to about 600 mg/m$^2$, more preferably from about 150 to about 400 mg/m$^2$ relative to the surface layer. The binding agent of such layer preferably is gelatin, but treated gelatins like the so-called acid or basic gelatins, the gelatins treated with enzymes, deionized gelatin, gelatin derivatives and modified gelatins can also be used.

The silver halide photographic materials of the present invention are fore-hardened. Typical examples of organic or inorganic hardeners include chrome salts (e.g., chrome alum, chromium acetate), aldehydes (e.g., formaldehyde and glutaraldehyde), isocyanate compounds (hexamethylene diisocyanate), active halogen compounds (e.g., 2,4-dichloro-6-hydroxy-s-triazine), epoxy compounds (e.g., tetramethylene glycol diglycidylether), N-methylol derivatives (e.g., dimethylolurea, methyloldimethyl hydantoin), aziridines, mucohalogeno acids (e.g., mucochloric acid), active vinyl derivatives (e.g., vinylsulfonyl and hydroxy substituted vinylsulfonyl derivatives) and the like. Other references to well known hardeners can be found in *Research Disclosure*, December 1989, Vol. 308, Item 308119, Section X. According to a preferred embodiment of the present invention, the silver halide photographic material is fore-hardened with a 1,3,5-triazine hardener. Useful examples of 1,3,5-triazine hardeners are, for example, sodium salts of 2-hydroxy-4,6-dichloro-1,3,5-triazine or 2-chloro-4,6-dihydroxy-1,3,5-triazine. Other examples of 1,3,5-triazine hardeners can be found in U.S. Pat. Nos. 3,325,287, 3,288,775 and 3,992,366.

Photographic materials according to the invention generally comprise at least one light sensitive layer, such as a silver halide emulsion layer, coated on at least one side of a support.

Silver halide emulsions typically comprise silver halide grains which may have different crystal forms and sizes, such as, for example, cubic grains, octahedral grains, tabular grains, spherical grains and the like. Tabular grains having an aspect ratio higher than 3:1 are preferred.

Typical silver halide compositions include silver bromide, silver chloride, silver bromoiodide, silver chlorobromide, and silver bromochloroiodide or mixtures thereof. Silver bromide and silver bromoiodide having an iodide content lower than 5 mol % relative to the total halide content are preferred.

As a binder for silver halide emulsions, gelatin is preferred, but other hydrophilic colloids can be used, alone or in combination, such as, for example, dextran, cellulose derivatives (e.g.,hydroxyethylcellulose, carboxymethyl cellulose), collagen derivatives, colloidal albumin or casein, polysaccharides, synthetic hydrophilic polymers (e.g., polyvinylpyrrolidone, polyacrylamide, polyvinylalcohol, polyvinylpyrazole) and the like. Gelatin derivatives, such as, for example, deionized gelatin, acetylated gelatin and phthalated gelatin can also be used.

Silver halide emulsion layers can be sensitized to a particular range of wavelengths with a sensitizing dye. Typical sensitizing dyes include cyanine, hemicyanine, merocyanine, oxonols, hemioxonols, styryls, merostyryls and streptocyanines. The silver halide photographic material of the present invention can have one or more silver halide emulsion layers sensitized to the same or different regions of the electromagnetic spectrum. The silver halide emulsion layers can be coated on one side or on both side of a support base.

Examples of materials suitable for the preparation of the support include glass, paper, polyethylene-coated paper, metals, polymeric film such as cellulose nitrate, cellulose acetate, polystyrene, polyethylene terephthalate, polyethylene, polypropylene and the like.

Specific photographic materials according to the invention are black-and-white light-sensitive photographic materials, in particular X-ray light-sensitive materials. X-ray photographic materials can be coated single side or double side.

However other black-and-white photographic materials, such as lithographic light-sensitive materials, black-and-white photographic printing papers, black-and-white negative films, as well as light-sensitive photographic color materials such as color negative films, color reversal films, color papers, etc. can benefit of the use of the present invention.

The light sensitive layers intended for use in color photographic is material contain or have associated therewith dye-forming compounds or couplers. For example, a red-sensitive emulsion would generally have a cyan coupler associated therewith, a green-sensitive emulsion would generally have a magenta coupler associated therewith, and a blue-sensitive emulsion would generally have a yellow coupler associated therewith.

Other layers and additives, such as antistatic compositions, subbing layers, surfactants, filter dyes, intermediate layers, protective layers, anti-halation layers, barrier layers, development inhibiting compounds, speed-increasing agent, stabilizers, plasticizer, chemical sensitizer, UV absorbers and the like can be present in the photographic element.

A detailed description of photographic elements and of various layers and additives can be found in *Research Disclosure* 17643 December 1978, 18431 August 1979, 18716 November 1979, 22534 January 1983, and 308119 December 1989.

The silver halide photographic material of the present invention can be exposed and processed by any conventional processing technique. Any known developing agent can be used into the developer, such as, for example, dihydroxybenzenes (e.g., hydroquinone), pyrazolidones (1-phenyl-3-pyrazolidone, 4,4-dimethyl-1-phenyl-3-pyrazolidone), and aminophenols (e.g., N-methyl-p-aminophenol), alone or in combinations thereof. Preferably the silver halide photographic materials are developed in a developer comprising dihydroxybenzenes as the main developing agent, and pyrazolidones and p-aminophenols as auxiliary developing agents.

Other well known additives can be present in the developer, such as, for example, antifoggants (e.g., benzotriazoles, indazoles, tetrazoles), silver halide solvents (e.g., thiosulfates, thiocyanates), sequestering agents (e.g., aminopolycarboxylic acids, aminopolyphosphonic acids), sulfite antioxidants, buffers, restrainers, hardeners, contrast promoting agents, surfactants, and the like. Inorganic alkaline agents, such as KOH, NaOH, and LiOH are added to the developer composition to obtain the desired pH which is usually higher than 10.

The silver halide photographic material of the present invention can be processed with a fixer of typical composition. The fixing agents include thiosulfates, thiocyanates, sulfites, ammonium salts, and the like. The fixer composition can comprise other well known additives, such as, for example, acid compounds (e.g., metabisulfates), buffers (e.g., carbonic acid, acetic acid), hardeners (e.g., aluminum salts), tone improving agents, and the like.

The present invention is particularly intended and effective for high temperature, accelerated processing with automatic processors where the photographic element is transported automatically and at constant speed from one processing unit to another by means of roller. Typical examples of said automatic processors are 3M TRIMATIC TM XP515 and KODAK RP X-OMAT TM. The processing temperature ranges from 20° to 60° C., preferably from 30° to 50° C. and the processing time is lower than 90 seconds, preferably lower than 45 seconds. The good antistatic and surface characteristics of the silver halide photographic material of the present invention allow the rapid processing of the material without having the undesirable appearance of static marks or scratches on the surface of the film.

The invention will be described hereinafter by reference to the following examples.

EXAMPLE 1

A set of radiographic films was prepared by coating on a support a silver halide emulsion layer and a protective gelatin layer. Different polymeric matting agents and hardeners were added to the radiographic films.

EMULSION 1

Emulsion 1 was a cubic silver bromoiodide emulsion having 2.3 mol % iodide and an average diameter of about 0.7 μm. The emulsion was chemically sensitized with a sulfur compound and a gold compound, spectrally sensitized with 0.75 g/mole of silver of a green spectral sensitizer (5,5'-dichloro-9-ethyl-3,3'-di-(3-sulfopropyl)-oxa-carbocyanine hydroxide) and added with Kl in an amount of 60 mg/mole of silver.

EMULSION 2

Emulsion 2 was a cubic silver bromoiodide emulsion having 2.3% mole iodide and an average diameter of about 1.3 μm. The emulsion was chemically and spectrally sensitized as for emulsion 1.

EMULSION 3

Emulsion 3 was a tabular silver bromide emulsion having an aspect ratio of about 8:1 and a thickness lower than 0.4 μm. The emulsion was spectrally sensitized with the same green spectral sensitizer of emulsion 1 and chemically sensitized with sodium p-toluenethiosulfonate, sodium p-toluenesulfinate and benzothiazoleiodoethylate.

MATTING AGENT 1

Matting agent 1 was a dispersion of polydispersed polymethylmethacrylate (PMMA) beads having an average diameter of 4 μm and 99% by number of polymer particles showing a diameter of from 1.8 to 6.8. It was prepared by aqueous dispersion polymerization. The monomer was dispersed in water together with a polyvinylalcohol stabilizer and an anionic surfactant. A free radical initiator was added and polymerization was started upon heating. The obtained dispersion of PMMA particles was evaporated at 70° C. to separate the polymer particles.

MATTING AGENT 2

Matting agent 2 was a dispersion of monodispersed polymethylmethacrylate (PMMA) beads having an average diameter of 4.18 μm and 99% by number of polymer particles showing a diameter of from 3.7 to 4.6. It was prepared by solution-dispersion polymerization in organic media. The monomer was dissolved in methanol together with a polymeric stabilizer, a non-ionic surfactant and a radical initiator. Polymerization was started upon heating. The PMMA particles were separated by filtration and redispersed in water.

The above described silver halide emulsions were coated on both sides of a polyethylene terephthalate support (at a gelatin coverage of about 1.6 g/m$^2$) together with a hardener according to the following Table 1 (3.5% by weight relative to gelatin). A protective gelatin layer comprising the above described matting agents and the hardeners according to Table 1 (2% by weight relative to gelatin) was coated on each emulsion layer (at a gelatin coverage of about 1 g/m$^2$), thus obtaining the sample silver halide radiographic films from 1 to 7. Hardener 1 was a 1,3-bis-vinyl-sulphonyl-2-propanol, hardener 2 was a 2,4-dichloro-6-hydroxy-1,3,5-triazine and hardener 3 was a mixture of dimethylolurea and 2,4-dihydroxybenzaldehyde.

TABLE 1

| FILM | EMULSION | MATTING AGENT | HARDENER |
|---|---|---|---|
| 1 (c) | 1 | 1 | 3 |
| 2 (i) | 3 | 2 | 1 |
| 3 (c) | 3 | 1 | 1 |
| 4 (i) | 2 | 2 | 3 |
| 5 (c) | 2 | 1 | 3 |
| 6 (i) | 3 | 2 | 3 |
| 7 (i) | 3 | 2 | 2 |

(c) = comparison
(i) = invention

The antistatic and anti-blocking properties of the sample films 1 to 7 were evaluated according to the following methods.

CHARGE DECAY TIME TEST

According to this test the static charge dissipation of each of the films was measured. The films were cut into 45×54 mm samples and conditioned at 25% relative humidity and T=21° C. for 15 hours. The charge decay time was measured with a Charge Decay Test Unit JCI 155 (manufactured by John Chubb Ltd., London). This apparatus deposits a charge on the surface of the film by a high voltage corona discharge and a fieldmeter allows observation of the decay time of the surface voltage. The lower the time, the better the antistatic properties of the film. To prevent the charge decay behavior of the tested surface from being influenced by the opposite surface, this surface was grounded by contacting it with a metallic back surface.

SLIPPERING TEST

This test was performed with a Lhomargy apparatus. It consists of a slide moving on the film at a speed of about 15 cm/min. A force transducer connected to the slide transforms the applied force into an amplified DC voltage which is recorded on a paper recorder. The movement of the slide on the film is not continuous. The discontinuity of the movement can be measured (in terms of slipperiness difference) from the graph of the paper recorder. It was noted that the more the movement was discontinuous (i.e., the higher the value of slipperiness difference), the better was the performance of the film.

The following Table 2 shows the results of the above described tests.

TABLE 2

| FILM | CHARGE DECAY TIME (sec) | SLIPPERINESS DIFFERENCE |
|---|---|---|
| 1 | 288 | 11 |
| 2 | 180 | 14 |
| 3 | 290 | 12 |
| 4 | 190 | 12 |
| 5 | 252 | 10 |
| 6 | 200 | 15 |
| 7 | 90 | 15 |

The results of Table 2 show the improvement in antistatic and anti-blocking properties of the present invention. In comparing films 2 and 4 with films 3 and 5, respectively, it is evident that the use of the specific monodispersed PMMA can improve the antistatic and anti-blocking properties of the films. On the other hand, the comparison of films 2 and 6 with film 7 clearly shows that the combination of the monodispersed PMMA and triazine hardener of film 7 gives rise to a synergic effect with a superior result relative to other hardeners.

A set of 30 films for each example were exposed and processed in a 3M TRIMATIC TM XP-515 automatic processor at 35° C. for a total processing time of 60 seconds dry-to-dry, by developing with a ready-to-use developer having the following formulation:

| | | |
|---|---|---|
| Water | g | 700 |
| $Na_2S_2O_5$ | g | 84 |
| KOH 35% (w/w) | g | 135 |
| Boric acid | g | 2 |
| $K_2CO_3$ | g | 44 |
| Diethylene glycol | g | 20 |
| EDTA.4Na | g | 2 |
| BUDEX 5103.2Na 40% (w/w) | g | 7.5 |
| 5-Methylbenzotriazole | g | 0.15 |
| 1-Phenyl-1H-tetrazol-5-thiol | g | 0.067 |
| Hydroquinone | g | 30 |
| Phenidone | g | 2.5 |
| Sodium bromide | g | 2 |
| Water to make | l | 1 |
| pH at 20° C. | | 11.10 |

then fixing with a ready-to-use fixer having the following formulation:

| | | |
|---|---|---|
| $(NH_4)_2S_2O_3$ 60% (w/w) | g | 242 |
| $Na_2SO_3$ | g | 8 |
| Boric acid | g | 7 |
| $NH_4OH$ (25%) | g | 17 |
| $CH_3COOH$ | g | 22.5 |
| KI | g | 0.05 |
| Water to make | l | 1 |
| pH at 20° C. | | 5.0 |

Budex TM 5103 is the trade name of the morpholinomethanediphosphonic acid sodium salt.

After fixing the films were washed and dried.

When using films 1, 3, and 5 static marking took place after the passage of only 5 to 6 films, while more than 15 of films 2, 4 and 6 can be processed before appearance of static marks. None of the processed films 7 showed static marks.

We claim:

1. A silver halide photographic material comprising a support having coated thereon at least one silver halide emulsion layer and at least one light-insensitive hydrophilic colloid layer comprising gelatin wherein at least one of said layers comprises a gelatin hardening agent and said hydrophilic colloid layer comprises alkali-insoluble acrylic polymer particles having an average particle size of from 0.5 to 6 μm and wherein at least 95% by number of said polymer particles have a particle size within ±15% of the average particle size.

2. The silver halide photographic material according to claim 1 wherein said alkali-insoluble acrylic polymer is obtained from free radical polymerization of an acrylic monomer selected in the class of acrylic and methacrylic esters.

3. The silver halide photographic material according to claim 1 wherein said alkali-insoluble acrylic polymer is obtained from free radical polymerization of methylmethacrylate.

4. The silver halide photographic material according to claim 1 wherein said alkali-insoluble polymer particles have an average particle size of from 2 to 5 μm and wherein at least 99% by number of said polymer particles have a particle size within ±10% of the average particle size.

5. The silver halide photographic material according to claim 1 wherein said gelatin hardening agent is a substituted 1,3,5-triazine.

6. The silver halide photographic material according to claim 1 wherein said gelatin hardening agent is a 2,4-di-chloro-6-hydroxy-1,3,5-triazine.

7. A process to reducing static marking in a silver halide photographic element which comprises coating a top layer on said silver halide photographic element wherein said top layer comprises a hydrophilic colloid and an alkali-insoluble acrylic polymer particles having an average particle size of from 0.5 to 6 μm and a particle size distribution and wherein at least 95% by number of said polymer particles have a particle size within ±15% of the average particle size.

8. The process of claim 7 wherein said alkali-insoluble polymer particles is obtained from free radical polymerization of an acrylic monomer selected in the class of acrylic and methacrylic esters.

9. The process of claim 7 wherein said alkali-insoluble polymer particles is obtained from free radical polymerization of methylmethacrylate.

10. The process of claim 7 wherein the silver halide photographic material further comprises a gelatin hardening agent.

11. The process of claim 7 wherein said gelatin hardening agent is a substituted 1,3,5-triazine.

12. The process of claim 7 wherein said gelatin hardening agent is a 2,4-dichloro-6-hydroxy-1,3,5-triazine.

* * * * *

UNITED STATES PATENT AND TRADEMARK OFFICE

CERTIFICATE OF CORRECTION

PATENT NO. : 5,441,860

DATED : August 15, 1995

INVENTOR(S) : Fornasari et al.

It is certified that error appears in the above-indentified patent and that said Letters Patent is hereby corrected as shown below:

Column 4, line 40, delete "photographic is layer" and insert --photographic layer--.

Column 6, line 2, delete "photographic is material" and insert --photographic material--.

Signed and Sealed this

Ninth Day of January, 1996

*Attest:*

*Attesting Officer*

BRUCE LEHMAN

*Commissioner of Patents and Trademarks*